US005337894A

United States Patent [19]

Ivey

[11] Patent Number: 5,337,894

[45] Date of Patent: Aug. 16, 1994

[54] MULTI-VESSEL RECEPTACLE FOR LAPAROSCOPIC INSTRUMENTS

[76] Inventor: Troy D. Ivey, 1825 N. Harrison Rd., East Lansing, Mich. 48823

[21] Appl. No.: 54,254

[22] Filed: Apr. 30, 1993

[51] Int. Cl.[5] ..... B65D 85/20

[52] U.S. Cl. ..... 206/370; 206/443; 422/104

[58] Field of Search ..... 206/45.14, 370, 443, 206/446, 523, 562, 563; 211/74; 422/104

[56] References Cited

U.S. PATENT DOCUMENTS

| | | | |
|---|---|---|---|
| D. 217,851 | 6/1970 | Yankovich . | |
| 1,474,891 | 11/1923 | Burt et al. | 211/74 |
| 1,763,461 | 6/1930 | Fowler | 206/45.14 |
| 2,557,420 | 3/1949 | Elliott . | |
| 2,741,913 | 4/1956 | Dovas | 211/74 |
| 2,790,547 | 4/1957 | Sutton | 206/562 |
| 3,446,342 | 3/1967 | Michel . | |
| 3,474,913 | 10/1969 | Jungner et al. | 211/74 |
| 3,604,566 | 9/1971 | Rem et al. | 211/74 |
| 3,682,597 | 8/1972 | Husch | 422/104 |
| 4,090,850 | 5/1978 | Chen . | |
| 4,349,109 | 9/1982 | Scordato et al. | 206/562 |
| 4,495,150 | 1/1985 | Cook et al. | 422/104 |
| 5,057,282 | 10/1991 | Linder . | |

*Primary Examiner*—Jimmy G. Foster
*Attorney, Agent, or Firm*—Richard C. Litman

[57] ABSTRACT

The invention proposes a disposable multi-vessel receptacle having a plurality of vertically oriented hollow vessels for the receipt of laparoscopic instruments. Planar top and bottom retainers are used to rigidly retain the hollow vessels in a fixed, laterally spaced-apart relationship. The retainers and hollow vessels comprise an internal assembly. The internal assembly is contained within an exterior enclosure. Flaps are provided on the exterior enclosure as a means for enclosing the internal assembly from the outside environment, and thus maintain internal sterility. Prior to packaging and distribution for use, the multi-vessel receptacle and its contents are thoroughly sterilized.

14 Claims, 3 Drawing Sheets

MULTI-VESSEL RECEPTACLE FOR LAPAROSCOPIC INSTRUMENTS

FIELD OF THE INVENTION

The present invention generally relates to a receptacle for receiving laparoscopic instruments and is generally used to facilitate laparoscopic surgical procedures.

BACKGROUND OF THE INVENTION

The use of small fiberoptic visualizing aids has greatly advanced the field of surgery. Through the use of such fiberoptic aids a surgeon is able to make a small incision into a patient and visualize regions of the anatomy that would have otherwise required significantly more invasive procedures. In combination with surgical instrument modified to fit and operate through the small incision, it is also possible to conduct delicate surgery without having to make large surgical incisions. Laparoscopic cholecystectomies is one form of fiberoptic guided surgery and involves the surgical removal of a diseased or otherwise afflicted gall bladder.

During laparoscopic cholecystectomies, a surgeon is usually assisted by several surgical assistants. One such assistant is usually assigned the role of operating a laparoscopic camera while another is assigned to provide the surgeon with various sterilized laparoscopic surgical instruments as needed during the surgery. Typically, these laparoscopic instruments are placed on a tray or table distant from the immediate operating arena, thus requiring unnecessary and potentially intrusive "walking about" by the assigned surgical assistant. This problem has long continued without significant abatement or satisfactory resolution. Apart from inconvenience, disorganization and intrusiveness, the present practice also requires the addition of another staff member to an already typically crowded surgical team, thus increasing hospital costs and the related fees to the patient.

In light of the existing problems, a multi-vessel receptacle for laparoscopic surgical instruments has been designed that may be used to retain instruments in an area within the reach of the surgeon conducting the laparoscopic procedures. Such a receptacle would conceivably end the need to have surgical assistants performing tasks that this device can accomplish simply and more cost effectively. The labor of such surgical assistants can be redirected to more productive ends.

Prior patents have been directed to assorted means for organizing or otherwise arranging medical devices. U.S. Pat. No. 2,557,420, issued to Elliot on Jun 19, 1951, was directed to device with a tubular arrangement for the storage of hypodermic needles. U.S. Pat. No. 3,446,342, issued to Michel on May 27, 1969, was directed to a mailing package having a "Styrofoam" body and sockets for holding biological samples. U.S. Pat. No. 4,090,850, issued to Chen on May 23, 1978, was directed to a tray for use in radioimmunoassays. U.S. Pat. No. 5,057,282, issued to Linder on Oct. 15, 1991, is directed to a pipette shipping package of lightweight materials. Not one of these patent disclose or suggest a device that adequately solves the problems outlined above or contains all the features of the present invention.

SUMMARY OF THE INVENTION

Briefly, the present invention provides a multi-vessel receptacle ergonomically designed for retaining laparoscopic instruments in an easily accessible and organized fashion. The multi-vessel receptacle is used during laparoscopic surgical procedures. The multi-vessel receptacle has an internal vessel assembly comprising a plurality of vertically oriented vessels held in uniform spatial relationship by rigid internal planar retainers. The internal vessel assembly itself is associated with and contained within an exterior enclosure.

Accordingly, one of the objects of the invention is to provide a multi-vessel receptacle for accessibly organizing laparoscopic instruments.

A further object of the invention is to provide an internal vessel assembly for organizing laparoscopic instruments which may be used with an external enclosure, but may also function separately from said external enclosure.

A further object of the invention is to provide a multi-vessel receptacle designed specifically for retaining laparoscopic instruments.

A further object of the invention is to provide a device for retaining laparoscopic instruments in staggered configuration so as to allow easy physical and visual accessibility of retained laparoscopic instruments.

A further object of the invention is to provide a durable, structurally sound multi-vessel receptacle for laparoscopic instruments with few parts that may be made inexpensively.

A further object of the invention is to provide a sterile, easily disposable multi-vessel receptacle for laparoscopic instruments.

A further object of the present invention is to provide a sterile multi-vessel receptacle for laparoscopic instruments with minimized exposed surface area.

With these and other objects in view which will more readily appear as the nature of the invention is better understood, the invention consists in the novel construction, combination and assembly of parts hereinafter more fully described, illustrated, and claimed with reference being made to the attached drawings.

BRIEF DESCRIPTION OF THE DRAWINGS

It is noted that similar reference characters designate corresponding parts throughout the several figures of the drawings.

DETAILED DESCRIPTION OF THE INVENTION

The present invention will now be described in further detail with reference to the drawings.

Figure 1:
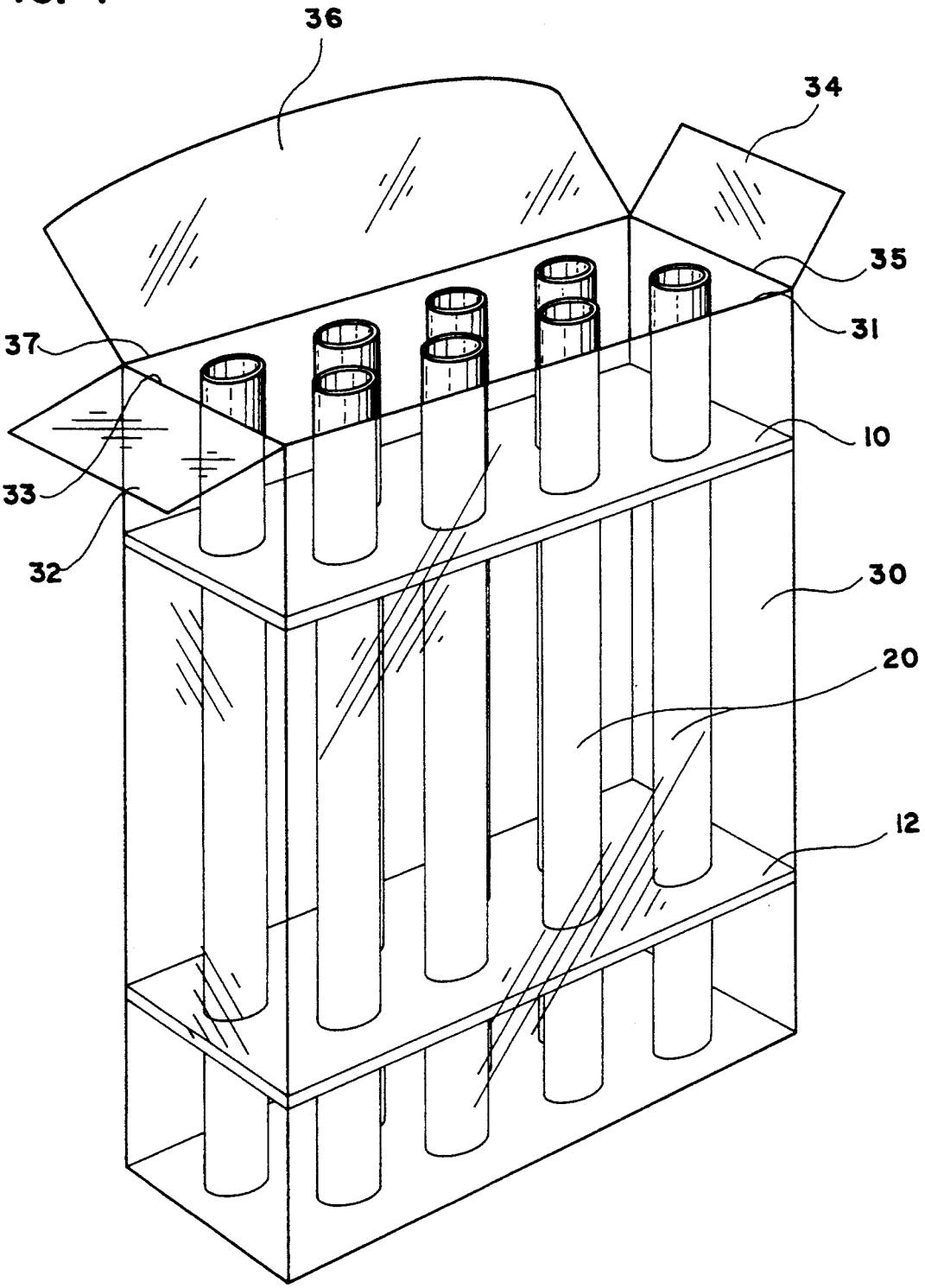
FIG. 1 is a front perspective view of one embodiment of the multi-vessel laparoscopic instrument receptacle.

FIG. 1 illustrates an embodiment of the present invention showing an exterior enclosure 30 with a top access 38 and an internal vessel assembly comprised of a plurality of laparoscopic instrument vessels 20, each rigidly retained in a spaced-apart, upright position by upper and lower planar internal retainers 10, 12. In practice, all surfaces on both exterior enclosure 30 and the internal vessel assembly should be maintained sterile.

Figure 3:
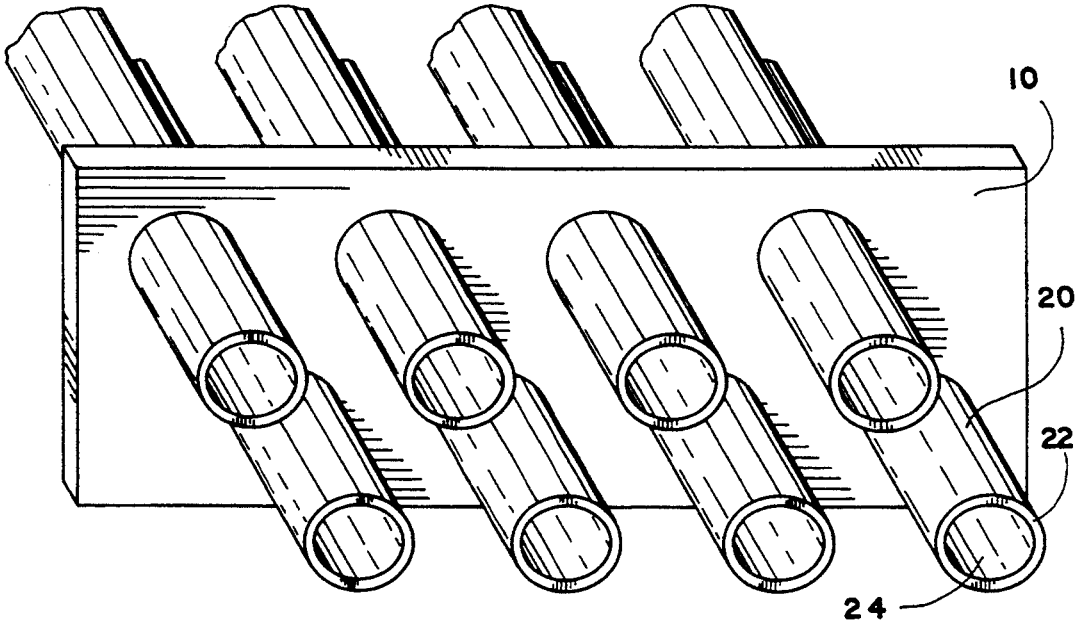
FIG. 3 is a perspective view of the upper portion of the internal vessel assembly of the multi-vessel laparoscopic instrument receptacle illustrated in FIG. 1.

As shown in FIG. 3, the upper end of laparoscopic instrument vessel 20 has an opening allowing access into vessel internal cavity 24. Vessel internal cavity 24 generally runs the entire length of laparoscopic instrument vessel 20 with its boundaries defined by vessel wall 20. In operation, laparoscopic instruments may be inserted into vessel internal cavity 24 of laparoscopic instrument vessel 20. Lateral movement of the instrument is limited by vessel wall 20.

Figure 2:
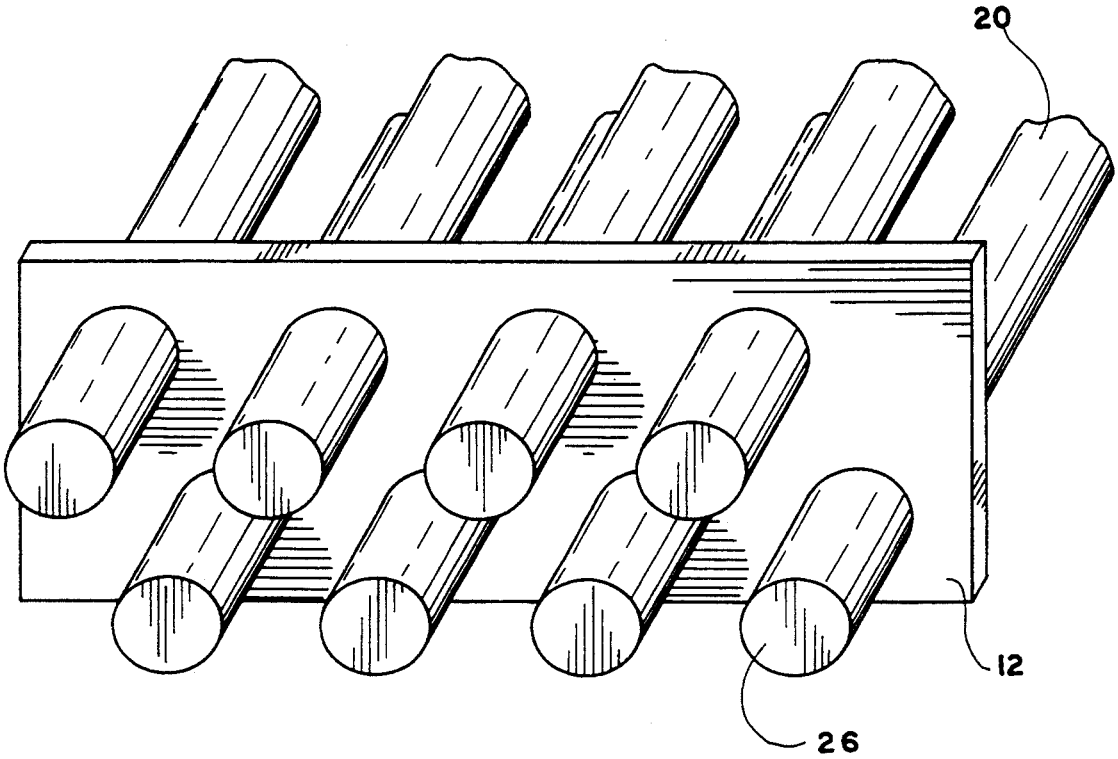
FIG. 2 is a perspective view of the bottom portion of the internal vessel assembly of the multi-vessel laparoscopic instrument receptacle illustrated in FIG. 1.

As shown in FIG. 2, the bottom end of the laparoscopic instrument vessels may be plugged with bottom vessel seal 26. Bottom vessel seal 26 may be integral with laparoscopic instrument vessel 20. The bottom vessel seal 26 prevent laparoscopic instruments from falling through laparoscopic instrument vessel 20 in the event that the inserted laparoscopic instrument does not have protuberances that will abut and catch against vessel wall 22.

As shown in FIG. 1, it is noted with emphasis that laparoscopic instrument vessels 20 sit on the bottom of exterior enclosure 10. In this configuration, laparoscopic instrument vessels 20 (together with retainers 10, 12) support the exterior enclosure 30 when the multi-vessel receptacle is placed down on a floor, table or like surface; the exterior enclosure does not directly support the laparoscopic instrument vessels 20 or the upper and lower planar internal retainers 10, 12. However, when the multi-vessel receptacle is carried with the exterior enclosure 30 (i.e. not bottom supported), the exterior enclosure 10 provides direct support to the contained laparoscopic instrument vessels 20; vessels 20 are not supported by upper and/or lower internal retainers 10, 12. This particular feature, not only improves structural stability under the many environments in which this portable device may be used, but is also tied to the fact that internal vessel assembly, in certain embodiments, may be separated from the exterior enclosure 30 and used separately apart from the exterior enclosure 30.

Figure 4:
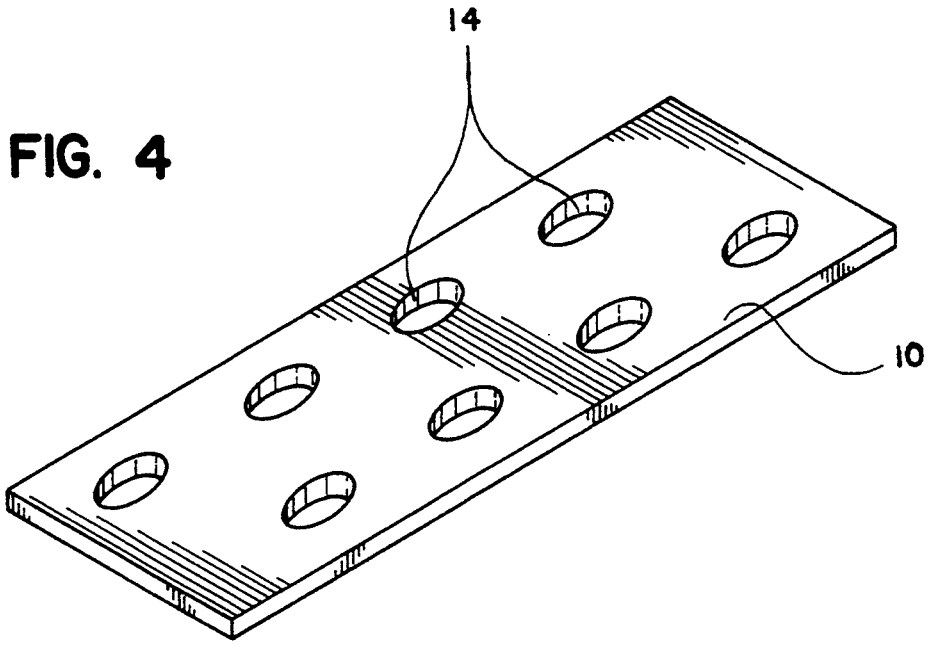
FIG. 4 is a perspective view of one possible planar internal retainer that may be used in accordance with the present invention.

FIG. 4 illustrates upper planar internal retainer 10 in further detail. As shown, upper planar internal retainer 10 has a plurality of vessel receiving apertures 14. Vessel receiving apertures 14 penetrate the entire thickness of upper planar internal retainer 10. The internal diameter of each vessel receiving aperture 14 is substantially corespondent with the outer diameter of the laparoscopic instrument vessel 20 such that, when the laparoscopic instrument vessels 20 are fitted onto the upper planar internal retainer 10, a sufficient tension is formed so that the relative positions of the laparoscopic instrument vessels 20 and upper planar internal retainer 10 will be maintained during the foreseeable use of the multi-vessel receptacle. Accordingly, this "rigid retention" would encompass permanent attachment, temporary attachment and all ranges in between. Permanent attachment is desirable for disposable embodiments of the invention for maximizing structural solidity, since disengageability of parts for separate sterilization prior to reuse is not a concern. Loose fitting attachment, wherein the laparoscopic instrument vessels 20 are allowed to freely slide through vessel receiving apertures 14, are undesirable and may be counter-productive. Rigid retention could be accomplished by any number of means, such as bolt/screw configurations, glue, friction, rubber gaskets, washer assemblies, flanges, etc.

As provided in the embodiment illustrated in FIG. 1, the dimensions and structural configuration of lower planar internal retainer 12 correspond with upper planar internal retainer 10. Accordingly, the vessel receiving apertures 14 in upper planar internal retainer 10 are aligned in linear correspondence with the vessel receiving apertures of lower planar internal retainer 12. This corresponding linear alignment provides uniform dimensional stability when the laparoscopic instrument vessels are vertically supported by the retainers 10 and 12.

It is possible that means for rigidly retaining the laparoscopic instrument vessels 20 in an upright position can be utilized other than the upper and lower planar internal retainers 10, 12 used in the embodiment illustrated in FIG. 1. For example, a solid styrofoam or sponge block with transverse passages may also be utilized to retain the laparoscopic instrument vessels 20. As another example, exterior enclosure 10 may be filled with particulate matter and the laparoscopic instrument vessels 20 embedded therein. While other examples may be contemplated, they are not preferred on the basis that such means either raise the cost of manufacture and/or are difficult to maintain sterile. With specific regard to block-type retaining structures, the upper and lower surfaces of such block structures presumptively serve the same function as the upper and lower planar internal retainers 10, 12 used in the embodiment illustrated in FIG. 1, but with the disadvantage of adding unnecessary bulk.

As shown the embodiment illustrated in FIG. 1, the periphery of upper planar internal retainer 10 is in direct contact with the inside of exterior enclosure 30. If the seal accomplished by the direct contact is tight, the seal is able to close off the lower regions of the internal vessel assembly from the outside ambient environment. As such, the surface area of the internal vessel assembly remaining exposed to the outside environment is lessened. Such a feature minimize the area of the multi-vessel instrument that must be kept sterile and is thus desirable, especially for non-disposable embodiments of the invention.

As shown in FIGS. 1, 2 and 3, laparoscopic instrument vessels 20 are arranged in a staggered row configuration. While the staggered row configuration is not critical to the practice of the invention, such an arrangement significantly advanced the desirability of using the multi-vessel receptacle for the purposes set forth above. When staggered, several interrelated advantages are realized. First, the arrangement maximizes the number of laparoscopic instrument vessels 20 that may be retained by upper and lower planar internal retainers 10, 12, without unduly sacrificing the structural rigidity of retainers 10 and 12. In this regard, each vessel receiving aperture is provided with a larger area of surrounding material than would be possible in an unstaggered configuration. The relative spatial triangulation of the apertures 14 also increase lateral rigidity. Second, the staggered configuration also provides enhanced accessibility to any instruments contained within the laparoscopic instrument vessels 20 to a degree not possible in an unstaggered configuration.

Structural stability of the multi-vessel receptacle is also enhanced by virtue of the relative placement of upper and lower planar internal retainers 10, 12 along the length of laparoscopic instrument vessels 20. As shown in FIG. 1, upper and lower planar internal retainers 10, 12 are positioned along the length of laparoscopic instrument vessels 20, so as to define upper, intermediate and lower zones. It is believed that greater structural stability of the internal vessel assembly is achieved when the intermediate zone is as large as possible and the upper and lower zones are of substantially equal lengths. Equivalent arrangement would be within the capacity of any person skilled in the pertinent art.

The embodiment illustrated in FIG. 1 is further provided with a left flap 32, a right flap 34, and a central flap 36 positioned along the top edge of the exterior enclosure 30. Top access 38 of exterior enclosure 30 is defined by front edge 31, left edge 33, central edge 37 and right edge 35. Left flap 32 is integral with exterior enclosure 30 at the fold line defining left edge 33. Right flap 34 is integral with exterior enclosure 30 at the fold line defining right edge 35. Central flap 36 is integral exterior enclosure 30 at the fold line defining central edge 37. In operation, to maintain the sterility or otherwise prevent contamination of the internal vessel assembly, left flap 32, right flap 34 and central flap 36 may be sequentially folded inward to cover top access 38. In this regard, central flap 36 is of sufficient dimensions as to contact and/or overhang front edge 31. Left, central and right flaps 32, 36, 34 are not critical for the operation of the multi-vessel receptacle. However, if desired, the dimensions of flaps 32, 36 and 34 may be varied as needed in accordance with the invention.

Figure 5:
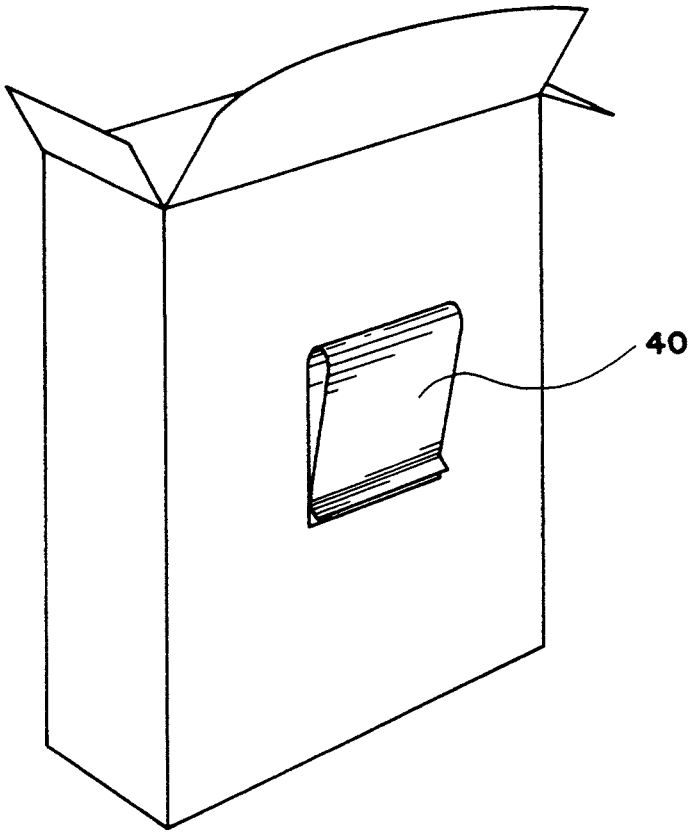
FIG. 5 is a rear perspective view of an embodiment of the present invention wherein the exterior enclosure is provided with attachment means.

As shown in the embodiment illustrated in FIG. 5, exterior enclosure 30 may be fitted with means (such as clip 40) for conveniently attaching the multi-vessel assembly to external point sources, such as hospital bed linens, surgical gowns, belts, IV poles, etc. Examples of attachment means would include magnet means, clip means, VELCRO means, cord means, tacky adhesive means, etc. The attachment means may be placed on any suitable spot on the exterior enclosure 30, including central flap 36, right flap 34 and left flap 32. In certain situations, central flap 36, right flap 34 and left flap 32 may in themselves be used as an attachment means. For example, the multi-vessel receptacle may be supportedly attached to an IV pole by using a hemostat to secure central flap 36 to any suitable spot on the pole.

In disposable embodiments of the invention, the multi-vessel assembly may be packaged pre-sterilized within an exterior packaging material (not shown). While the external package material need not in itself be sterile, it must be manufactured of a material that is capable of maintaining the sterility of its contents over an extended period of time. Depending on particular circumstances, the external packaging material may be made of plastic, fabric or cloth.

Finally, one very specific embodiment of the invention that is especially useful in laparoscopic surgical procedures, has an exterior enclosure that is 28 cm×18 cm×6 cm. In this very specific embodiment, the laparoscopic instrument vessels are cylindrical tubes 28 cm in height with a diameter of 2 cm; the planar internal retainers are 6 cm×18 cm with eight 2 cm diameter apertures staggered in two rows. This specific embodiment is provided only as a guideline and is not intended to limit the full scope of the invention.

It is to be understood that the present invention is not limited to the embodiments described above, but encompasses any and all embodiments within the scope of the following claims.

Further, while the present invention has been described with reference to its use for retaining laparoscopic surgical instruments, the invention may be used to retain other surgical instruments.

I claim:

1. A sterilizable multi-vessel receptacle for removably receiving laparoscopic instruments comprising a removable internal vessel assembly and an exterior enclosure completely surrounding said internal vessel assembly to maintain internal sterility;

said internal vessel assembly comprising a plurality of hollow vessels adapted to each receive a laparoscopic instrument and retaining means for retaining said plurality of hollow vessels together as a unit for use thereof in an operating room during surgical procedures;

each of said hollow vessels having an open top end and a closed bottom end, and said retaining means comprising a pair of spaced, planar surfaces adapted to rigidly retain each of said vessels in a substantially upright position;

said enclosure having sides, a bottom region, and a removably covered top access;

said internal vessel assembly contained in said enclosure such that said open top ends of each of said hollow vessels are accessible through said top access when uncovered;

said plurality of hollow vessels contactable with said bottom region of said enclosure such that said internal vessel assembly is restable on said bottom region of said enclosure through said plurality of hollow vessels.

2. The multi-vessel receptacle of claim 1, wherein said vessel retaining means is comprised of a top vessel retaining surface and a bottom vessel retaining surface, said vessel retaining surfaces each having at least one aperture therein, said apertures being of a size to fictionally engage an associated vessel.

3. The multi-vessel receptacle of claim 2, wherein said top vessel retaining surface and said bottom vessel retaining surface are frictionally positioned relative to said plurality of hollow vessels so as to define an upper zone, intermediate zone and a lower zone on each of said hollow vessels;

each of said upper zones and said lower zones having substantially equal lengths; and each of said intermediate zones having lengths larger than each of said upper zones.

4. The multi-vessel receptacle of claim 2, wherein said top vessel retaining surface has a first plurality of apertures and said bottom vessel retaining surface has a second plurality of apertures;

said first plurality of apertures are in substantially linear correspondence with said second plurality of apertures.

5. The multi-vessel receptacle of claim 4, wherein said first plurality of apertures are arranged in a staggered row configuration.

6. The multi-vessel receptacle of claim 1, wherein said hollow vessels each have different dimensional widths and said surfaces are dimensioned to frictionally engage said sides of said enclosure to assist in maintaining internal sterility.

7. The multi-vessel receptacle of claim 1, further comprising attachment means for attaching the multi-vessel receptacle to an external point;

said attachment means located on said enclosure.

8. A multi-vessel receptacle for laparoscopic instruments comprising an internal vessel assembly and an enclosure;

said internal vessel assembly comprising a plurality of hollow vessels and retaining means for retaining said plurality of hollow vessels;

each of said hollow vessels having an open top end and a bottom end, and said retaining means adapted to rigidly retain each of said vessels in a substantially upright position;

said enclosure having a bottom region and a top access;

said internal vessel assembly contained in said enclosure such that said open top ends of each of said hollow vessels are accessible through said top access;

said plurality of hollow vessels contactable with said bottom region of said enclosure such that said internal vessel assembly is restable on said bottom region of said enclosure through said plurality of hollow vessels, said enclosure further comprising a left flap, right flap, and central flaps dimensioned to cover said top access; and said top access of said enclosure has a left edge, right edge and a central edge; and said left flap connected to said enclosure at said left edge, said right flap connected to said enclosure at said right edge, and said central flap connected to said enclosure at said central edge.

9. A multi-vessel receptacle for laparoscopic instruments comprising an internal vessel assembly and an enclosure;

said internal vessel assembly comprising a plurality of hollow vessels and retaining means for retaining said plurality of hollow vessels;

each of said hollow vessels having an open top end and a bottom end, and said retaining means adapted to rigidly retain each of said vessels in a substantially upright position;

said enclosure having a bottom region and a top access;

said internal vessel assembly contained in said enclosure such that said open top ends of each of said hollow vessels are accessible through said top access;

said plurality of hollow vessels contactable with said bottom region of said enclosure such that said internal vessel assembly is restable on said bottom region of said enclosure through said plurality of hollow vessels, further comprising attachment means for attaching the multi-vessel receptacle to an external point;

said attachment means being located on said enclosure, and said attachment means being a clip.

10. A multi-vessel sterilizable receptacle for laparoscopic instruments comprising an internal vessel assembly and an enclosure completely surrounding said internal vessel assembly;

said internal vessel assembly comprising a plurality of hollow vessels and retaining means for retaining said plurality of hollow vessels;

each of said hollow vessels having an open top end and a bottom end, and said retaining means adapted to retain each of said vessels in a substantially upright position; said vessel retaining means is comprised of a top vessel-retaining surface and a bottom-vessel retaining surface, said top vessel-retaining surface having a periphery, said enclosure having a removably covered top access, an interior side and an exterior side;

said internal vessel assembly contained in said enclosure such that said open top ends of each of said hollow vessels are accessible through said top access when uncovered;

said interior side of said enclosure being in substantial contact with said periphery of said top vessel-retaining surface to maintain internal sterility.

11. The multi-vessel receptacle of claim 10, wherein said top vessel-retaining surface and said bottom vessel-retaining surface are positioned relative to said plurality of hollow vessels so as to define an upper zone, intermediate zone and a lower zone on each of said hollow vessels;

each of said upper zones and said lower zones having substantially equal lengths; and each of said intermediate zones having lengths larger than each of said upper zones.

12. The multi-vessel receptacle of claim 11, wherein said upper zone is substantially close to the top open end of each of said hollow vessels.

13. The multi-vessel receptacle of claim 10, wherein said top vessel retaining surface has a first plurality of apertures and said bottom vessel retaining surface has a second plurality of apertures;

said first plurality of apertures are in substantially linear correspondence with said second plurality of apertures.

14. The multi-vessel receptacle of claim 13, wherein said first plurality of apertures are arranged in a staggered row configuration.

* * * * *